US011401755B2

(12) United States Patent
Fischer et al.

(10) Patent No.: US 11,401,755 B2
(45) Date of Patent: Aug. 2, 2022

(54) GROUND DRILLING DEVICE, TRANSFER DEVICE OF A GROUND DRILLING DEVICE, CONTROL OF A TRANSFER DEVICE OF A GROUND DRILLING DEVICE AND METHOD FOR CONTROL OF A GROUND DRILLING DEVICE

(71) Applicant: TRACTO-TECHNIK GmbH & Co. KG, Lennestadt (DE)

(72) Inventors: Sebastian Fischer, Lennestadt (DE); Niklas Berens, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/825,855

(22) Filed: Mar. 20, 2020

(65) Prior Publication Data

US 2020/0318444 A1 Oct. 8, 2020

(30) Foreign Application Priority Data

Apr. 8, 2019 (DE) ..... 10 2019 002 549.0

(51) Int. Cl.
*E21B 7/04* (2006.01)
*E21B 44/00* (2006.01)
*E21B 19/15* (2006.01)

(52) U.S. Cl.
CPC ..... *E21B 19/15* (2013.01); *E21B 7/046* (2013.01); *E21B 44/00* (2013.01)

(58) Field of Classification Search
CPC ..... E21B 19/15; E21B 7/046; E21B 19/155; E21B 19/14; E21B 19/20; E21B 17/006; B65G 1/0442; B65G 2201/0276; F16L 1/065; F16L 1/207; G05B 19/4183; G05B 2219/45129; G06Q 20/203; G06Q 10/087
See application file for complete search history.

(56) References Cited

U.S. PATENT DOCUMENTS 4,202,653 A * 5/1980 Moller ..... B65G 1/0442 414/22.57
4,742,470 A * 5/1988 Juengel ..... G05B 19/128 340/10.34
5,202,680 A * 4/1993 Savage ..... E21B 47/13 340/853.1

(Continued)

FOREIGN PATENT DOCUMENTS

DE 10206645 A1 * 8/2003 ..... E21B 7/046
DE 10 2009 035 277 A1 2/2011

(Continued)

*Primary Examiner* — Gregory W Adams
(74) *Attorney, Agent, or Firm* — Howard IP Law Group, PC

(57) ABSTRACT

A ground drilling device having a drilling carriage, which defines a drill string axis, a rod magazine for a plurality of different rod sections and a transfer device for the transfer of a rod section between the rod magazine and the drill string axis, wherein the rod magazine is adapted for a horizontal arrangement of the rod sections in adjacent compartments for access by means of the transfer device from above, wherein a control unit of the transfer device is designed to select a particular rod section in the rod magazine depending on at least one borehole parameter and/or at least one rod section parameter.

19 Claims, 1 Drawing Sheet

(56) References Cited

U.S. PATENT DOCUMENTS 5,360,967 A * 11/1994 Perkin ..... E21B 17/006 235/375
6,021,377 A * 2/2000 Dubinsky ..... E21B 7/068 702/9
6,419,029 B2 7/2002 Bayer et al.
8,240,968 B2 * 8/2012 Hopkins ..... E21B 19/155 414/22.55
8,562,269 B2 10/2013 Hermes et al.
8,636,459 B2 * 1/2014 Neeper ..... G01N 35/0099 414/280
8,719,118 B2 * 5/2014 Hacker ..... E21B 19/14 705/28
8,753,059 B2 * 6/2014 Baker ..... A61B 50/30 414/269
8,863,859 B2 * 10/2014 Koch ..... E21B 47/007 175/39
8,905,160 B1 12/2014 Verzilli et al.
9,030,324 B2 * 5/2015 Christiansen ..... G06K 7/10009 340/572.8
9,354,623 B2 * 5/2016 Magnuson ..... G05B 15/02
9,926,744 B2 * 3/2018 Lane ..... E21B 44/00
2010/0104401 A1 4/2010 Hopkins et al.
2012/0133526 A1 * 5/2012 Christiansen ..... G01V 15/00 340/854.6
2014/0006227 A1 * 1/2014 Griggs ..... E21B 17/006 705/28
2016/0194950 A1 * 7/2016 Zheng ..... E21B 19/20 73/152.04
2016/0291201 A1 * 10/2016 Tunc ..... E21B 47/04
2019/0055831 A1 2/2019 Fischer

FOREIGN PATENT DOCUMENTS

DE 10 2017 118 853 A1 2/2019
EP 0 945 588 A2 9/1999
EP 2 578 797 A1 4/2013
EP 3 444 433 A1 2/2019
WO 2017/185164 A1 11/2017

* cited by examiner

GROUND DRILLING DEVICE, TRANSFER DEVICE OF A GROUND DRILLING DEVICE, CONTROL OF A TRANSFER DEVICE OF A GROUND DRILLING DEVICE AND METHOD FOR CONTROL OF A GROUND DRILLING DEVICE

FIELD OF INVENTION

The invention relates to a ground drilling device, a transfer device of a ground drilling device, a control unit of a transfer device of a ground drilling device and a method for control of a ground drilling device.

BACKGROUND

From DE 10 2009 035 277 A1 there is known a drilling device, comprising a rod magazine with a plurality of rod sections stored therein, a drilling carriage, as well as a transfer device, with which the rod sections can be removed from the rod magazine and be positioned in the drilling carriage. The rod magazine is positioned next to a base support of the drilling carriage. The rod magazine has the shape of a cuboid and is composed of a plurality of interconnected frame profiles. At the top end of the rod magazine the magazine has an open configuration, so that the transfer device can reach into the rod magazine and remove a rod section. The transfer device is connected by a carrier frame to both an outer wall of the rod magazine and the base support of the drilling carriage. Horizontally oriented racks are present on the carrier frame, meshing together with driving gears of a drive. A gripping unit of the transfer device can be moved along the horizontal racks in the horizontal direction.

SUMMARY

It has been discovered that, while the known drilling devices achieve good results, the time to produce an earth borehole may be long, especially due to a manual selection of the rod sections by means of an operator and/or a loss of the drill string due to fatigue or loss of a rod section.

Now, the problem which the invention proposes to solve is to provide a ground drilling device, a transfer device of a ground drilling device, a control unit for a transfer device of a ground drilling device, and a method for control of a ground drilling device in which a simple designed ground drilling device can be used with less time for introducing an earth borehole, in particular, down time owing to nonuniform wear or nonuniform grinding of individual rod sections of a drill string can be reduced.

The key notion of the invention is to select certain rod sections from the rod magazine in the form of an automatic work sequence, without requiring an interaction with an operator. A control unit can undertake the selection of a rod section intended to prolong the drill string already laid in the soil. The selection can be done according to various criteria and/or requirements. For example, the selection can be done such that the rod sections located in the rod magazine are removed in a particular sequence, dictated by the control unit, in order to lengthen the drill string. Accordingly, the selection can be predetermined by a given sequence of removal. The rod sections are selected according to the type of position in the rod magazine. In such a case, the rod magazine can be filled with rod sections according to the predetermined sequence, observing the sequence in this way. But it is also possible—in addition or alternatively—to select the rod sections located in the rod magazine according to a requirement or a criterion, in addition or alternatively. For example, it may be provided that information is present in the form of one or more rod section parameters about the individual rod sections present in the rod magazine. The information regarding the rod section may be, for example, the length of time for which the rod section was already used to make an earth borehole. The rod section parameter or parameters may also be information on the kind of loading experienced by the rod section during previous earth boreholes. Besides or in addition to or instead of or alternatively to the at least one rod section parameter, a criterion for the selection may also include at least one borehole parameter. The borehole parameter may be information regarding the borehole being made, such as the period of time and/or the further spatial length or extension to advance the earth borehole in the soil. In this way, it is possible to determine how long the rod sections located in the drill string will be subjected to a loading. The borehole parameter or parameters may also be the material encountered or yet to be encountered by the drill head, and what load this will produce on the drill string. The borehole parameter may also be a parameter allowing for a possible (further) bending of the drill string. In particular, the lifetime of the rod sections can be optimized and the rod sections can be dynamically and at least (semi) automatically organized in terms of their utilization.

The inventors have discovered that an at least semi-automatic selection of a particular rod section from the rod magazine constitutes a substantial advantage for the operator and ultimately the owner of the ground drilling device. The operator need no longer make any selection, and for this reason alone the earth borehole can be produced more quickly, furthermore making possible an optimized selection. It is possible to optimize the execution of a predetermined sequence, which can be optimized in terns of access time to the rod magazine. But also in addition or alternatively, the selection can make possible and thus optimize an optimized selection of particular rod sections for the application in terms of particular criteria by means of information about the borehole being made (borehole parameters) and/or information on individual rod sections (rod section parameters). A restacking or repositioning of the rod sections located in the rod magazine may be possible. The restacking can be done at least semi-automatically, in order to grasp a particular rod section that was not accessible prior to the restacking, for example, since it was covered by one or more rod sections, for example.

The invention creates a ground drilling device with a drilling carriage, which defines a drill string axis. The ground drilling device comprises a rod magazine for a plurality of different rod sections and a transfer device for the transfer of a rod section between the rod magazine and the drill string axis. The rod magazine is adapted for a horizontal arrangement of the rod sections in adjacent compartments for access by means of the transfer device from above. A control unit of the transfer device is designed to select a particular rod section in the rod magazine depending on at least one borehole parameter or/and at least one rod section parameter.

The term "ground drilling device" encompasses in the sense of the specification any device which moves in particular a drill string having rod sections in an existing or yet to be created conduit in the soil, in order to create or widen a borehole, especially a horizontal borehole (HD), or to draw pipelines or other long bodies into the soil. The ground drilling device may be in particular a HD device. A ground drilling device may be a device driving forward a drill string, which can work in particular by soil displacement. The drill string can be introduced into the soil by translatory and/or rotatory movement in the lengthwise axial direction of the drill string. A borehole may be placed in the soil by applying pulling or pushing to the drill string.

The term "soil" encompasses in the sense of the present specification in particular any kind of material, especially earth, sand and/or rock, in which existing or yet to be created conduits or boreholes can be made, preferably being horizontal at least for a portion.

The term "drilling carriage" encompasses a frame, especially a movable frame, on which a sled can be provided for moving the drill string, which can move back and forth in the direction of the drill string axis in order to move the drill string in the soil by pushing or pulling. The drilling carriage generally comprises at least the sled and/or a linear drive for advancement of the drill string. The linear drive may additionally or alternatively comprise a rotation drive for the rotational driving of the drill string. The drilling carriage can moreover comprise one or more clamping devices, by which the drill string or a rod section being attached can be secured. It may be provided that a clamping device is provided on the drilling carriage, by means of which the free end of the drill string can be secured, in order to make possible a connecting of a newly attached rod section to the already introduced drill string.

The term "drill string axis" means in particular the axis formed by the longitudinal axes of the individual rod sections of the drill string. In particular, the longitudinal axes of the rod sections which are situated in the near region of the ground drilling device or the drilling carriage in the drill string are considered. In particular, the last and/or next to last rod section in the drill string, whose longitudinal axis is dictated by the drive element engaging with the last rod section, is considered. Basically, the drill string axis can be defined by the drilling carriage, since a sled can move on the drilling carriage, with which a holder can travel, in which a rod section can be placed in order to connect the rod section to the introduced drill string.

The term "drill string" in the sense of the invention encompasses any means which can be introduced into the soil in order to make a borehole in the soil. In particular, the drill string may comprise a rod, a chain, and/or a cable. The term "drill string" encompasses in the sense of the specification not only rigid, individual drill strings having rod sections connected directly or indirectly to each other, but also in particular any force transmitting elements which can be used in a ground drilling device. Moreover, the drill string comprises at one end, especially the front end, a drilling head and optionally a drilling head tip or a region adjacent to the drilling head, which may have in particular the same orientation as the drilling head. In an especially preferred embodiment, it is proposed to design a front end segment of a drill string as a drilling head or drilling tool. The drill string may also comprise a sensor section or a sensor housing, in which a sensor is arranged, making possible a position and/or attitude determination, especially a roll angle in regard to the position determination.

The term "transfer device" in the sense of the specification encompasses a device for holding or lifting a rod section, especially by means of one or more holding or lifting devices. The transfer device may be adapted both to transfer a rod section from the rod magazine into the drill string axis (making an earth borehole by pushing) or to transfer a rod section from the drill string axis into the rod magazine (pulling the drill string out from the soil).

In particular, a holding device or lifting device can be designed as a grasping device, although other configurations are also possible, including a combination with a grasping device or also alternatively without a grasping device. A holding device for example may also comprise a magnet or electromagnet, with which the rod section or a magnet or magnetized section arranged on the rod section can interact in order to form at least temporarily a releasable connection of the holding device to the rod section. The rod section can be lifted up and moved by means of the holding device from the rod magazine.

Generally a holding device is configured as a grasping device, so that the transfer device may comprise at least one grasping device; more than one grasping device are also possible, in particular, the transfer device comprises two grasping devices, which are arranged on a beam with an axial lengthwise spacing from each other. The grasping device can grasp a rod section at least for a portion along a circumferential segment. The transfer device has a capability of travel of the at least one grasping device, by means of which a rod section can be picked up or grasped, especially in the rod magazine, and can travel to a position in the direction of the drill string axis. It may also be possible for the transfer device to move a rod section from a position in the direction of the drill string axis to the rod magazine, for example, when the drill string is pulled out from the soil. The at least one gripping device can be moved vertically and horizontally, both transversely to and in the longitudinal direction, parallel to the drill string axis. The transfer device may be designed in particular substantially like the transfer device known from DE 10 2009 035 277 A1.

A "rod magazine" in the sense of the specification encompasses in particular a magazine having two end elements or head pieces, on which separating elements are provided. The separating elements may be oriented toward each other in particular, so as to dictate a partitioning or compartments or rows of the rod sections in the rod magazine. The separating elements may extend across the entire length between the end elements. It is also possible for the separating elements to extend across the entire length between the two end elements. The term "rod magazine" in the sense of the specification also encompasses a string as is known from DE 10 2009 035 277 A1.

The rod magazine enables an arrangement of the rod sections of a substantially horizontal arrangement. The rod sections may lie in direct contact on one another in the rod magazine; each time two rod sections can have direct contact with each other. Adjacent rod sections in a compartment can have direct contact with each other. The width of the compartments transversely to the longitudinal axis of the rod magazine can basically correspond to the width of a rod section. In the compartments, columns may be formed in particular, having the width of one rod section (transversely to the longitudinal axis of the rod magazine) and being several rod sections high.

In the rod magazine, positions can be defined by the formation of compartments at which a rod section can be positioned or arranged. Due to the recumbent arrangement of the rod sections, not all defined positions are possible when the rod magazine is not fully loaded, since empty positions cannot be present between two adjacent rod sections. These empty intermediate positions are eliminated because the rod sections lie on one another. On the other hand, it is only possible to access (at the start) the uppermost rod section of a compartment or a column. The positions defined in the rod magazine by means of the compartments and the thickness of the rod sections can be indexed and/or numbered for purposes of visualization and/or coordination. By means of the index and/or the number, a distinct coordination of a position in the rod magazine is possible. A coordination can be done or can exist as to whether and which rod section is present at a position in the rod magazine. The coordination can be kept track of by means of the control unit, especially when a (new) rod section (new) is placed in the rod magazine, when a rod section is repositioned in the rod magazine and/or when a rod section is removed from the rod magazine.

The term "control unit" in the sense of the specification encompasses a configuration by means of a hardware and/or software, by means of which a directional influencing in operation is possible. The control unit may comprise a hardware component and/or a software component. The control unit may be present as a separate hardware component, which is integrated in a control unit of a ground drilling device and/or can be functionally connected to it. The hardware component may be electrical or electronic. A hardware component of the control unit can also be implemented at least partly in the control unit of the ground drilling device and make use of the processor for the operation of the ground drilling device. Accordingly, the hardware component may be at least partly identical or identical to the hardware for the control unit of the ground drilling device. The control unit may comprise a command sequence as a software component, which can be executed on a processor, which can be configured as a separate processor (separate hardware component) or be configured as a processor of the ground drilling device. The hardware component comprises the processor, which is configured as an arithmetic unit with electronic circuits, in order to execute commands. In one preferred embodiment, the control unit also comprises a command sequence, which can be executed on the processor. The command sequence may be configured in the form of a program. The command sequence may act in directed or targeted manner on the transfer device, in order to select specifically a rod section present in the rod magazine; the command sequence determines the next rod section to be selected. The selected rod section can be found by the transfer device through an index or a number for the position in the rod magazine.

The term "at least one" and corresponding grammatical forms of the indefinite article "a" for the following noun encompass in the sense of the specification the possibility of one, two, three, four or another whole number of elements denoted by the noun being present or considered.

Insofar as it is specified that the particular rod section is selected depending on at least one borehole parameter or/and at least one rod section parameter, this will take into account basically two criteria. In the sense of the specification, "borehole parameters" are parameters in a more or less relationship with the earth borehole being produced. A borehole parameter may be the length of the earth borehole yet to be produced, i.e., the remaining portion of the earth borehole being produced. The length may be indicated in the form of the time still remaining and/or the section yet to be drilled. A borehole parameter may be an indication of the (current) thrust force to be applied by the drive unit. A borehole parameter may be the (current) rotary speed of the drive unit, wherein the current rotary speed can be the instantaneous rotary speed during the current drilling or a "total" rotary speed during the current drilling. A borehole parameter may be the (current) pulling force of the drive unit, especially during the drilling currently being done. The at least one borehole parameter can allow for circumstances of the drilling being done, especially due to the drilling length and/or the soil being drilled through.

By a "rod section parameter" is meant a parameter which is coordinated with the respective rod section as information about it. For example, the rod section can be coordinated with how often and/or how long it has already been used to make an earth borehole. A rod section parameter may also be the total advancement force exerted on the rod section in terms of a thrust loading. A rod section parameter may be a torsional loading from preceding earth boreholes. A rod section parameter may be a tensile loading from preceding earth boreholes. A rod section parameter may be a bending loading from preceding earth boreholes. A rod section parameter may also be the wear associated with the rod section, resulting from at least one of the aforementioned loads of previous earth boreholes (thrust load, tensile load, torsional load, bending load). In one preferred embodiment, a lifetime computation can be associated as the rod section parameter with individual rod sections. In this way, it is possible to indicate and allow for the loading for each individual rod section experienced by the rod section in previous boreholes. In particular, one can consider how long and in what position the rod section was located in the drill string. The lifetime computation may include information from the following machine data: torsion, tensile load, thrust load and rotary speed. From the machine data of the drive device, one can then determine the torsion load, tensile/compressive load, torque, number of uses in a drill string (especially number of screwing operations to attach the rod sections for a wear on the thread) and/or rotary speed (especially number of revolutions performed by each individual rod section due to the alternating bending stress) of the individual rod sections. Furthermore, it is possible to detect a bending stress, especially one in the form of a bending radius, of the rod sections and to take this into account in the lifetime computation. In particular, the detection of the lifetime can be done as described in DE 10 2017 118 853 A1.

The rod section parameters for the individual rod sections can preferably be stored separately, this being done especially preferably in a storage element which is connected to the respective rod section itself. By providing individual or all rod sections with corresponding storage elements, one can prevent the rod section parameters from being confused with each other. Furthermore, there is no costly data administration, which combines the different rod sections for different work projects and at different work sites. However, it is also possible for a rod section to have a code individualizing the rod section and to keep in a central coordination the data regarding one or more rod section parameters for the individual rod sections. In the sense of the specification, the term "central" describes the presence of the possibility for the rod section parameters of multiple rod sections being present at one location, i.e., "centrally". The location may be the ground drilling device or a memory configured in or at the ground drilling device. The ground drilling device may access the memory in which the rod section parameter or parameters for the individual rod sections are kept. For the coordinating of the rod section parameters in a central stockpile or storage, it is possible to store the values for the individual rod sections centrally and to provide each rod section with an identifiable code (e.g., serial number of the rod section, which can be determined optically, for example), which is then coordinated with the centrally stored values.

The term "storage element" in the sense of the specification relates to any given data storage or a storage medium, which can be electronically written into and/or read out in particular. The storage element can store information on the basis of electronic semiconductor components or other components. The storage element in particular may be a non-volatile memory. A noncontact reading and/or writing of data on the storage element is preferred. A storage element may preferably be a large RFID chip, usually comprising an antenna, an analog circuit and a digital circuit, and a permanent memory. The RFID chip may be a passive, active, or semi-active RFID chip.

Preferably, the control unit for the selection of a particular rod section can interact with a method for determining the wear on a string of a ground drilling device or a device for determining the wear on a ground drilling device, such as is known for example from EP 3 444 433 A1. Thus, the control unit may be functionally connected to the control unit of the ground drilling device and/or the drive of the ground drilling device, in order to keep track of or memorize the wear on the rod sections. The mentioned alternatives allow for the fact that the control unit can also be designed as part of the control unit of the ground drilling device. Accordingly, a functional connection also includes an identity or partial identity in the hardware between the control unit and the control unit of the ground drilling device.

Insofar as it is specified that a particular rod section is "selected", this means that the term includes not only an active and/or constantly made selection of a particular rod section, but also that rod sections are selected according to a predetermined sequence, such as in terms of the position where the pod sections are placed in the rod magazine. Accordingly, a selection of a particular rod section is also tantamount to a sequence in which the rod sections present in the rod magazine are accessed, for example, with the aid of their position. A selection in this context is also an execution of a predetermined sequence of rod sections at predetermined positions in the rod magazine. A "selecting" in this context also refers to a specific accessing of individual rod sections in a predetermined sequence, dictated by the control unit. In regard to the selection in a predetermined sequence, special consideration can be given to arranging the rod sections when producing an earth borehole in the reverse sequence to the stockpiling or placement of the previous earth borehole in the drill string. For example, the first rod section of the previous borehole can be used as the last rod section of the drill string of the next borehole. The second rod section of a previous earth borehole can be used as the next to last rod section in the next earth borehole.

Besides or in addition to the execution of a given sequence, the rod sections can also be selected by the control unit according to at least one of the parameters, i.e., the borehole parameter or/and the rod section parameter. The selection can be done not only according to a predetermined sequence, but also spontaneously, for example, by responding to currently present borehole parameters (the ascertained advancement force of the drive). The currently present machine data of the drive unit of the device may indicate, for example, a heightened strain on the drill string, meaning that, given the corresponding borehole parameters, one or more particular rod sections will be selected, not yet exceeding a given wear limit Thus, with the aid of a (current) borehole parameter, a selection of a particular rod section can be done. For example, the control unit can select rod sections for which currently existing conditions of the earth borehole can be taken into account—even possibly unexpected harsh conditions. Besides the borehole parameter or parameters, at least one rod section parameter can also be taken into account, especially the one associated with the wear. Accordingly, a combination of borehole parameter(s) and rod section parameter(s) can provide the basis for the selection.

It may be provided that the nature of the choice in regard to the criterion or the dependency by which a particular rod section is chosen can change during the making of the earth borehole. In this way, a flexible response to different circumstances is possible. For example, one rod section may be selected in one phase of the earth drilling according to a predetermined sequence. In a further phase of the earth drilling, the criterion for the selection may change and deviate from the predetermined sequence, and a selection can be done in dependence on the at least one borehole parameter or/and the at least one rod section parameter.

The coordinating of the rod section parameter with the individual rod sections present in the rod magazine can be done in such a way that one or more rod section parameters is or are saved for one position in the rod magazine, being coordinated with the respective rod section. The coordinating can be done in such a way that the control unit, for example in the form of a memory, produces a coordination table as to which rod section is located at which position in the rod magazine. The information coordinated with the rod section in the form of one or more rod section parameters can then be done through the identification of the rod section. Likewise, alternatively or additionally, it may also be provided that the information of the rod section, i.e., the one or more rod section parameters, is directly coordinated with the position in the rod magazine. If the rod section is repositioned in the rod magazine or moved to a different position, the respective coordinations are changed.

In one preferred embodiment, the control unit is adapted to rearrange rod sections by means of the transfer device inside the rod magazine in order to grasp a particular rod section by means of the transfer device and/or to optimize the positions for rod sections which will be selected next. This makes possible a free selection of a particular rod section, for example a rod section not arranged on top in a compartment, but instead situated beneath at least one other rod section. Good flexibility can be achieved in this way.

The repositioning can be done during a period of time in which the drive unit of the ground drilling device is introducing the drill string further into the soil or pulling it out. The repositioning can occur in the form of a sorting, which sorts the rod sections in the rod magazine into a predetermined sequence or arrangement, this arrangement being made in particular according too at least one of the two borehole parameters and rod section parameters. For example, the sorting can enable an optimal access to the least worn-down rod sections. The sorting can take into account the amount of a wear condition as the rod section parameter for the rod sections and calculate an optimal storing or arranging in the rod magazine in the form of a position for the respective rod section. The repositioning to achieve the optimal storage can be optimized in terms of the fewest steps (repositioning processes) to be performed.

The sorting can be done when stockpiling a rod section, for example, when pulling in the drill string (especially after widening the borehole). In this way, a frequently and/or heavily used rod section will be sorted at the bottom in the rod magazine, instead of being placed at the top in a compartment, "blocking" the access to rod sections lying underneath. The rod section sorted at the bottom—insofar as it is not again sorted to the top for access—can thus be used only after the other rod sections lying above it have been used and especially only when the other rod sections in the rod magazine have attained a similar or worse wear condition as the rod section parameter. While the drive unit is pulling the drill string further from the soil, the last rod section pulled from the soil can be sorted or stockpiled optimally in the rod magazine.

A sorting of the rod sections in the rod magazine can be done also or alternatively when the ground drilling device is starting up. In this condition as well, the time for an optimization of the position of the rod sections in the rod magazine can also be used meaningfully.

The sorting and/or optimized stockpiling of a rod section can thus be done in parallel with the starting up and/or moving of the drill string, so that the sorting and/or optimized stockpiling does not impede the actual making of the earth borehole or the pulling out of the drill string. This results in a high utility for the owner.

In one preferred embodiment, the control unit is functionally connected to a memory, in which information is kept regarding one or more rod section parameters matched up with the particular rod section. In this way, it is possible to track a corresponding parameter connected to the rod section.

The term "functionally connected" in the sense of the specification encompasses a connection of the mentioned device, especially a unidirectional or bidirectional connection, in order to provide signals in particular from one of the devices, especially the control unit, and to receive them from the other device, especially the memory, and/or to process the received signals. The functional coupling may be direct or indirect by the intervention of further elements or devices. The term "functionally connected" also includes the configuration where the control unit comprises the memory in its hardware component, i.e., the memory is at least partly integrated in the control unit.

In one preferred embodiment, the control unit is functionally connected to a detection unit, which is adapted to detect information regarding one or more rod section parameters. For example, the control unit and/or the control unit of the ground drilling device can be functionally connected to a detection unit, comprising a reading device, with which it is possible to read the information stored at a storage element on a rod section regarding one or more rod section parameters. The detection unit may be actively adapted for this, i.e., it reads out the data stored in a passive storage element. Alternatively, the reading device may also interact with active storage elements, which send the desired values to the reading device. The detection unit may be controlled by the control unit of the ground drilling device or by the control unit and it can read out the information regarding one or more rod section parameters for example when filling the rod magazine. For example, the control unit or the control unit of the ground drilling device can then be informed as to the position in which the rod section has been placed in the rod magazine, from which the information regarding the rod section parameter or parameters has been read out. Thus, the position in the rod magazine can be matched up with a rod section having a respective rod section parameter or rod section parameters. The coordination can be mapped out in a memory, which the control unit and/or the control unit of the ground drilling device can functionally access.

It may also be provided that, when filling the rod magazine, the individual rod sections are supplied to the rod magazine in the sequence in which the positions are numbered or indexed in the rod magazine. Before being placed in the rod magazine at the next position, the respective rod section can be taken to the detection unit and the information read out and stored in a memory for the respective position in the rod magazine.

It is also possible for an operator to coordinate the code of a rod section present in the rod magazine with a position in the rod magazine. The operator can enter a code for a position, in order to indicate information for the selection of the respective rod section in a coordination, which is or can be saved in a memory, with a position in the rod magazine.

The invention also creates a transfer device of a ground drilling device. The transfer device can be arranged on a ground drilling device comprising a drilling carriage. The drilling carriage defines a drill string axis. Moreover, a rod magazine for a plurality of rod sections can be arranged on the ground drilling device, being adapted for a horizontal arrangement of the rod sections in adjacent compartments. The transfer device comprises at least one holding device, with which the rod sections in the rod magazine can be grasped from above. The transfer device comprises a control unit, which is adapted to select a particular rod section present in the rod magazine depending on at least one borehole parameter or/and at least one rod section parameter.

The invention also creates a control unit of a transfer device of a ground drilling device, wherein the transfer device can be arranged on a ground drilling device comprising a drilling carriage, wherein the drilling carriage defines a drill string axis, and moreover a rod magazine for a plurality of rod sections can be arranged on the ground drilling device. The rod magazine is adapted for a horizontal arrangement of the rod sections in adjacent compartments. The transfer device comprises at least one holding device, with which the rod sections in the rod magazine can be grasped from above. The control unit is designed to select a particular rod section in the rod magazine depending on at least one borehole parameter or/and at least one rod section parameter.

The invention also creates a method for earth drilling with a ground drilling device. The method involves the step of selecting a rod section from different rod sections arranged horizontally and adjacent to each other in a rod magazine by means of a control unit, depending on at least one borehole parameter or/and at least one rod section parameter, in order to further advance the earth borehole in the soil with the selected particular rod section.

The invention is specified with regard to multiple aspects relating to a ground drilling device, a transfer device, a control unit and a method. The remarks on the individual aspects complement each other, so that the remarks for the ground drilling device are also to be understood as remarks of the specification for the transfer device, the control unit, and the method. The specification of the ground drilling device also discloses actions in the sense of the method or steps of the method regarding the method of earth drilling, which hold accordingly for the method of earth drilling.

The preceding remarks, just as the following description of exemplary embodiments, do not constitute any abandonment of particular embodiments or features.

BRIEF DESCRIPTION OF DRAWINGS

The invention shall now be explained more closely with the aid of an exemplary embodiment presented in the drawing. The drawings show.

DETAILED DESCRIPTION

Figure 1:
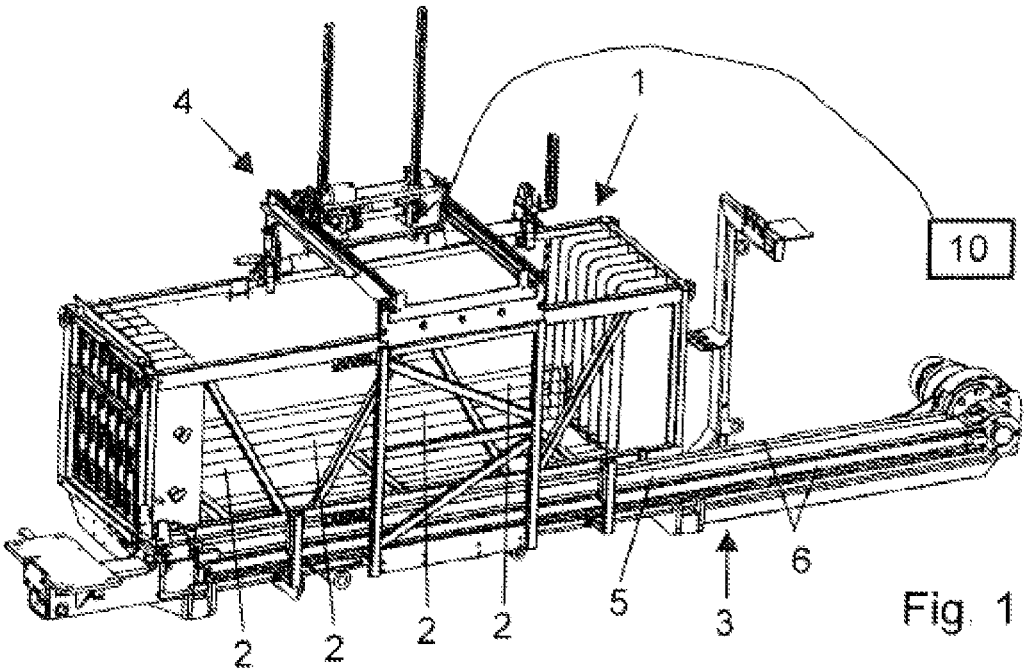
FIG. 1 a schematic representation of a ground drilling device.

FIG. 1 shows schematically a ground drilling device in isometric view. The ground drilling device comprises, as its essential subassemblies, a rod magazine 1 with a plurality of different rod sections 2 stored therein, a drilling carriage 3, of which only a portion is shown, and a transfer device 4, with which the rod sections 2 can be removed from the rod magazine 1 and placed in a position along the drill string axis on the drilling carriage 3.

The portion of the drilling carriage 3 shown comprises a support base 5, above which the individual rod sections 2 are positioned for a connecting to the free end of the already introduced drill string (not shown). Two rails 6 are provided on the support base 5 of the drilling carriage 3, on which a drive sled (not shown) can travel. The drive sled can be driven by means of a hydraulic motor 7 arranged at the end on the base support.

On the drive sled there is provided a rotation drive (not shown), which serves on the one hand for driving the drill string in rotation during its advancement, and on the other hand for screwing the newly attached rod section 2 to the free end of the already introduced drill string. For this, the rotation drive, whose drive shaft is provided with an external thread at its front end, is screwed into a threaded bush arranged at the back end on the rod section 2 and then the front end of the rod section 2, having a corresponding threaded bolt, is brought up to the free end of the drill string and screwed into the threaded busing of the last rod section 2 of the drill string.

The layout and the functioning of such drilling carriages 3 are sufficiently well known in the prior art. For example, DE 199 53 458 C1 discloses a corresponding drilling carriage, whose content in this regard is incorporated by reference in the present patent application.

The ground drilling device comprises a control unit 10, which is shown schematically in the form of a machine controller of the ground drilling device in FIG. 1. The control unit 10 of the ground drilling device is in this case identical to the control unit for the transfer device 4, by means of which a rod section 2 can be removed from the rod magazine 1 or placed therein.

In the control unit 10 of the ground drilling device, command sequences can be worked off, which allow a particular rod section 2 to be selected from the rod magazine 1.

Figure 2:
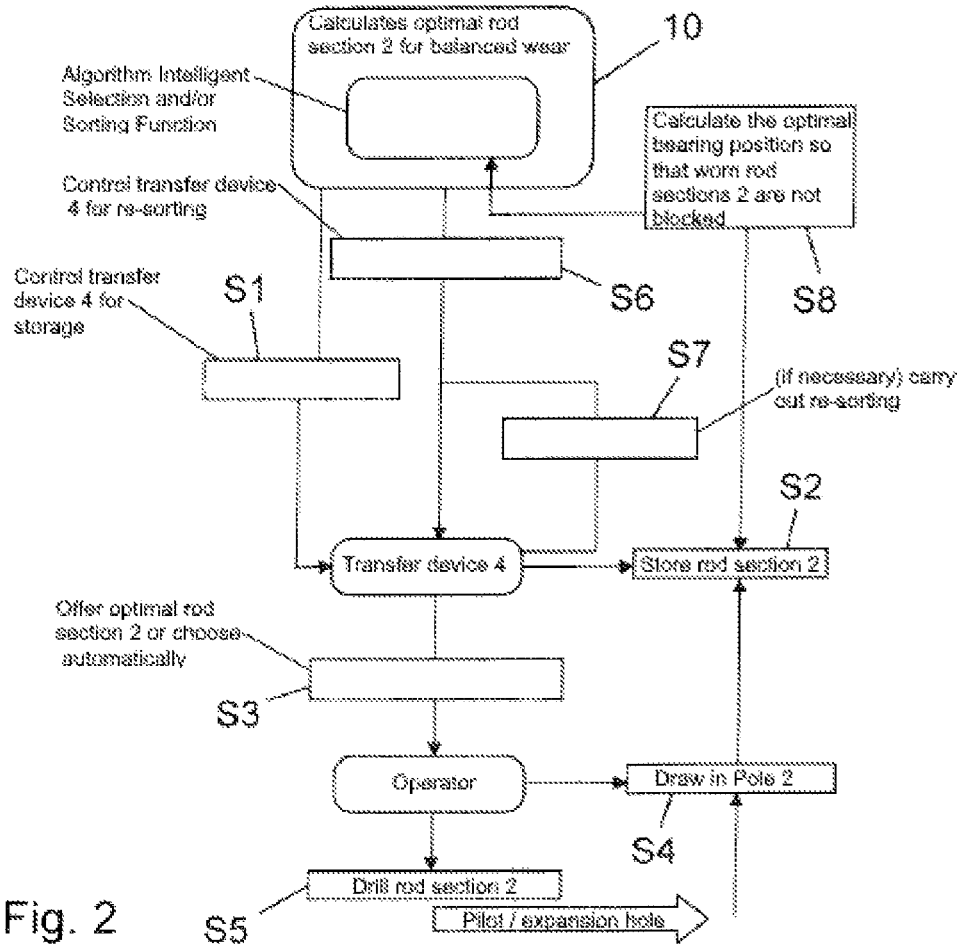
FIG. 2 an exemplary embodiment of a flow chart for a selection of a rod section in the rod magazine.

FIG. 2 shows as an example a flow chart enabling a selection of a rod section 2 in the rod magazine 1. The criterion considered for the selection of the rod section 2 in the rod magazine 1 is a wear associated with the rod section 2. By means of the command sequence implemented by the control unit 10, as represented by the flow chart in FIG. 2, a rod section resulting for a balanced wear can be selected. Furthermore, a repositioning or a sorting can be done in order to determine an optimized position for the rod section 2 in the rod magazine 1.

FIG. 2 shows the control unit 10 by means of which an algorithm or command sequence for the selecting or sorting of rod sections 2 in the rod magazine can be carried out. Accordingly, the control unit 10 can select an optimal rod section 2 for a balanced wear.

In step S1, the control unit 10 actuates the transfer device 4 for a stockpiling. Accordingly, the control unit 10 transmits commands with which access is gained to the transfer device 4. The accessing by the control unit 10 of the transfer device 4 by means of step S2 can bring about a placement of a rod section 2 in the rod magazine 1. In step S3, the transfer device 4 can choose or automatically select an optimal rod section 2. The selection can be indicated to an operator. The operator can confirm, in step S4, that the rod section 2 is pulled or in step S5 that the rod section 2 is introduced in the borehole.

While two columns are shown in FIG. 2, the difference is that in the case of the left column, i.e., steps S1, S3 and S5, a pilot borehole is made, i.e., a borehole in the soil where the drill string can be pushed in. In steps S2 and S4, there is a widening borehole, i.e., the drill string is generally pulled through the soil.

For the selection for the pilot borehole, in step S6 the transfer device 4 is actuated for a sorting or repositioning of the rod sections 2 in the rod magazine 1. In step S7, a sorting can be done by means of the transfer device 4. When stockpiling the rod section 2, which is described basically in step S2, an optimal position can be calculated by taking account of the criterion "state of wear" as a rod section parameter in step S8. The position can be optimized such that nonworn rod sections 2 are not blocked by worn rod sections 2 in the rod magazine 1.

The invention claimed is:

1. A ground drilling device comprising:

a drilling carriage, which defines a drill string axis, a rod magazine for a plurality of different rod sections, and a transfer device for the transfer of a rod section between the rod magazine and the drill string axis, wherein the rod magazine is adapted for a horizontal arrangement of the rod sections in adjacent compartments for access by means of the transfer device from above, and wherein a control unit of the transfer device is configured to select, during a making of an earth borehole in order to lengthen a drill string in the earth borehole, one or more rod sections in the rod magazine depending on: (a) at least one rod section parameter corresponding to wear data for the one or more rod sections, from use of the one or more rod sections in previous borehole operations, and (b) at least one currently present borehole parameter of the earth borehole being made, wherein the at least one currently present borehole parameter comprises current drive unit data of a drive unit of the ground drilling device used for making of the earth borehole.

2. The ground drilling device according to claim 1, wherein the control unit is configured to rearrange rod sections by means of the transfer device inside the rod magazine in order to grasp a particular rod section by means of the transfer device.

3. The ground drilling device according to claim 1, wherein the control unit is adapted to sort the rod sections in the rod magazine in a period of time in which the ground drilling device is applying pushing to the drill string.

4. The ground drilling device according to claim 1, wherein the control unit is adapted to sort the rod sections in the rod magazine in a period of time in which the ground drilling device is starting up.

5. The ground drilling device according to claim 1, wherein the control unit is functionally connected to a memory, in which information is kept regarding one or more rod section parameters matched up with the particular rod section.

6. The ground drilling device according claim 1, wherein the control unit is functionally connected to a detection unit adapted to detect information regarding the at least one or more rod section parameters.

7. The ground drilling device according to claim 1, wherein the control unit is functionally connected to the control unit of the ground drilling device and/or the drive unit of the ground drilling device, in order to monitor the wear of the rod sections.

8. The ground drilling device of claim 1, wherein the wear data corresponding to each of the plurality of rod sections comprises at least one of:

a number of times the rod section has previously been used in previous borehole operations;

a duration of time the rod section has been used in previous borehole operations;

a thrust load exerted on the rod section in previous borehole operations;

a torsional load exerted on the rod section in previous borehole operations;

a tensile load exerted on the rod section in previous borehole operations;

a bending load exerted on the rod section in previous borehole operations;

wear associated with the rod section resulting from the thrust load, the tensile load, the torsional load, and the bending load exerted on the rod section in the previous borehole operations; or a lifetime computation associated with the rod section.

9. The ground drilling device of claim 1, wherein the borehole parameter comprises at least one of:

a remaining length of a borehole to be drilled;

an indication of a current thrust force to be applied by the drive unit;

an indication of a current rotary speed of the drive unit;

an indication of a current pulling force of the drive unit;

a remaining time to drill the earth borehole; or a remaining length of the earth borehole.

10. The ground drilling device of claim 1, wherein the borehole parameter comprises an indication of a thrust force to be applied by the drive unit during drilling of the earth borehole being made.

11. The ground drilling device of claim 1, wherein the borehole parameter comprises an indication of a rotary speed of the drive unit during drilling of the earth borehole being made.

12. The ground drilling device of claim 1, wherein the borehole parameter comprises an indication of a pulling force of the drive unit during drilling of the earth borehole being made.

13. The ground drilling device of claim 1, wherein the borehole parameter comprises at least one of:

a material encountered by a drill head of the ground drilling device during drilling of the earth borehole being made; or a material to be encountered by the drill head during drilling of the earth borehole being made.

14. The ground drilling device of claim 13, wherein the borehole parameter comprises:

a load to be produced on the drill string by the material encountered by the drill head during drilling of the earth borehole being made; or a load to be produced on the drill string by the material to be encountered by the drill head during drilling of the earth borehole being made.

15. The ground drilling device of claim 1, wherein the current drive unit data comprises drive unit data received during the making of the earth borehole, comprising one or more of: rotary speed of the drive unit, thrust force of the drive unit, or a pulling force of the drive unit.

16. The ground drilling device of claim 1, wherein the current drive unit data comprises drive unit data received during the making of the earth borehole, indicative of a heightened strain on the drill string.

17. A transfer device arranged on a ground drilling device having a drilling carriage, wherein the drilling carriage defines a drill string axis, and a rod magazine for a plurality of rod sections for arrangement on the ground drilling device, the rod magazine adapted for a horizontal arrangement of the rod sections in adjacent compartments, the transfer device comprising:

at least one holding device adapted to grasp the rod sections in the rod magazine from above, and a control unit configured to select, during a making of an earth borehole in order to lengthen a drill string in the earth borehole, one or more rod sections present in the rod magazine depending on: (a) at least one rod section parameter corresponding to wear data for the one or more rod sections, from use of the one or more rod sections in previous borehole operations, and (b) at least one currently present borehole parameter of the earth borehole being made;

wherein the at least one currently present borehole parameter comprises current drive unit data of a drive unit of the ground drilling device used for making of the earth borehole.

18. A control unit of a transfer device arranged on a ground drilling device comprising a drilling carriage, wherein the drilling carriage defines a drill string axis, and a rod magazine for a plurality of rod sections for arrangement on the ground drilling device, the rod magazine adapted for a horizontal arrangement of the rod sections in adjacent compartments, the transfer device comprising:

at least one holding device adapted to grasp the rod sections in the rod magazine from above, wherein the control unit is configured to select, during a making of an earth borehole in order to lengthen a drill string in the earth borehole, one or more rod sections in the rod magazine depending on: (a) at least one rod section parameter corresponding to wear data for the one or more rod sections, from use of the one or more rod sections in previous borehole operations, and (b) at least one currently present borehole parameter of the earth borehole being made;

wherein the at least one currently present borehole parameter comprises current drive unit data of a drive unit of the ground drilling device used for making of the earth borehole.

19. A method for earth drilling with a ground drilling device, comprising selecting during a making of an earth borehole in order to lengthen a drill string in the earth borehole, one or more rod sections from different rod sections arranged horizontally and adjacent to each other in a rod magazine by means of a control unit, depending on: (a) at least one rod section parameter corresponding to wear data for the one or more rod sections, from use of the rod sections in previous borehole operations, and (b) at least one currently present borehole parameter of the earth borehole being made;

wherein the at least one currently present borehole parameter comprises current drive unit data of a drive unit of the ground drilling device used for making of the earth borehole.

* * * * *